United States Patent [19]

Liket

[11] 4,012,046

[45] Mar. 15, 1977

[54] GAME OF SKILL AND CHANCE

[76] Inventor: Hendrik Liket, 32 Bergen Blvd., Fairview, N.J. 07022

[22] Filed: June 9, 1975

[21] Appl. No.: 585,072

[52] U.S. Cl. ..... 273/134 C; 273/134 AT
[51] Int. Cl.[2] ..... A63F 3/00; A63F 9/14
[58] Field of Search ..... 273/134

[56] References Cited

UNITED STATES PATENTS

| | | | |
|---|---|---|---|
| 1,519,133 | 12/1924 | Hall | 273/134 C |
| 1,527,219 | 2/1925 | Potter | 273/134 AD |
| 1,695,144 | 12/1928 | Edwards | 273/134 C |
| 1,903,661 | 4/1933 | Storey | 273/134 C |
| 2,693,961 | 11/1954 | Ripley | 273/134 C |
| 2,976,044 | 3/1961 | Corpening | 273/134 AD |
| 3,427,027 | 2/1969 | Kenyon | 273/134 C |
| 3,807,739 | 4/1974 | Henley et al. | 273/134 AF |
| D211,798 | 7/1968 | Dillingham | 273/134 C UX |

*Primary Examiner*—Delbert B. Lowe
*Attorney, Agent, or Firm*—Richard L. Miller

[57] ABSTRACT

A game apparatus having a game board with a continuous path around its perimeter, the path being divided into consecutive spaces, each space bearing instructions for playing the game. Playing pieces are utilized by the game players to move around the spaces. Play money is distributed to the players with the remainder remaining in the bank. Two decks of standard playing cards are utilized. Some of the cards are distributed to the players; the remainder forming a supply for selection by the players in consecutive order. The playing cards serve as both a determination of the number of moves for each playing piece, as well as providing for unique combinations in the hands of the players to determine the winning player.

8 Claims, 2 Drawing Figures

GAME OF SKILL AND CHANCE

BACKGROUND OF THE INVENTION

This invention relates to a game apparatus and more specifically to a game involving both the skill and chance of the players.

Numerous game apparatus are presently available which provide entertainment to the players by challenging them so that they utilize their skill and acumen in playing the game while at the same time providing an element of chance to add a bit of adventure and luck to the game. Thus, combination of challenge and adventure gives the proper entertainment to the players of the game. Some of the game apparatus are generally referred to as board games, wherein a game board is utilized having various indicia contained thereon and utilizing playing pieces and chance determining means such as dice or spinners. Other types of games, generally referred to as card games, use a deck of cards containing indicia representing certain values and requiring the players to obtain combinations of such cards in order to triumph over their opponents.

Of the various types of card games, those that are most enjoyed are the ones utilizing a standard deck of playing cards. Such playing cards can be used for many games, all of which are based upon the objectives of having the player obtain a certain combination of the cards. While card games are very popular, they often lack the thrill and entertainment of a typical board game which has numerous playing instructions associated with each playing position.

It is accordingly an object of the present invention to provide a game of skill and chance which avoids the aforementioned shortcomings of prior art game apparatus.

A further object of the present invention is to provide a game apparatus which combines the features of both a board game and a card game.

Yet another object of the present invention is to provide a board game utilizing standard decks of playing cards.

A further object of the present invention is to provide a board game having playing pieces and play money, and utilizing at least two decks of playing cards, wherein the playing cards serve as both position determining means as well as winning determining means.

Yet a further object of the present invention is to provide a board game utilizing standard decks of playing cards which determine playing positions in the board game and also serve in the usual playing card capacity of forming combinations of playing cards for determining a winning hand.

Still a further object of the present invention is to provide a board game with a balance between skill and chance to provide entertainment to the players.

These and other objects, features and advantages of the invention will, in part, be pointed out with particularity, and will, in part, become obvious from the following more detailed description of the invention, taken in conjunction with the accompanying drawing, which forms an integral part thereof.

SUMMARY OF THE INVENTION

Briefly, the invention describes a game apparatus comprising, in combination, a game board having a continuous path around its perimeter divided into consecutive spaces; each space bearing instructions representing amounts to be paid or received. Each of the spaces defines a playing position. A plurality of playing pieces are included for use by the game players. The size of the playing pieces is such as to permit them to fit within the playing positions. Play money is also included, having different denominations, for distribution of at least part thereof to each player, the remainder of the money being placed within a bank. Two decks of standard playing cards are included for distribution of at least some of the cards among the players. The remainder of the cards are placed in a playing card position. The cards both determine the number of playing positions to be moved by the playing pieces as well as providing for combinations thereof to determine the winning player.

DESCRIPTION OF THE PREFERRED EMBODIMENT

Figure 1:
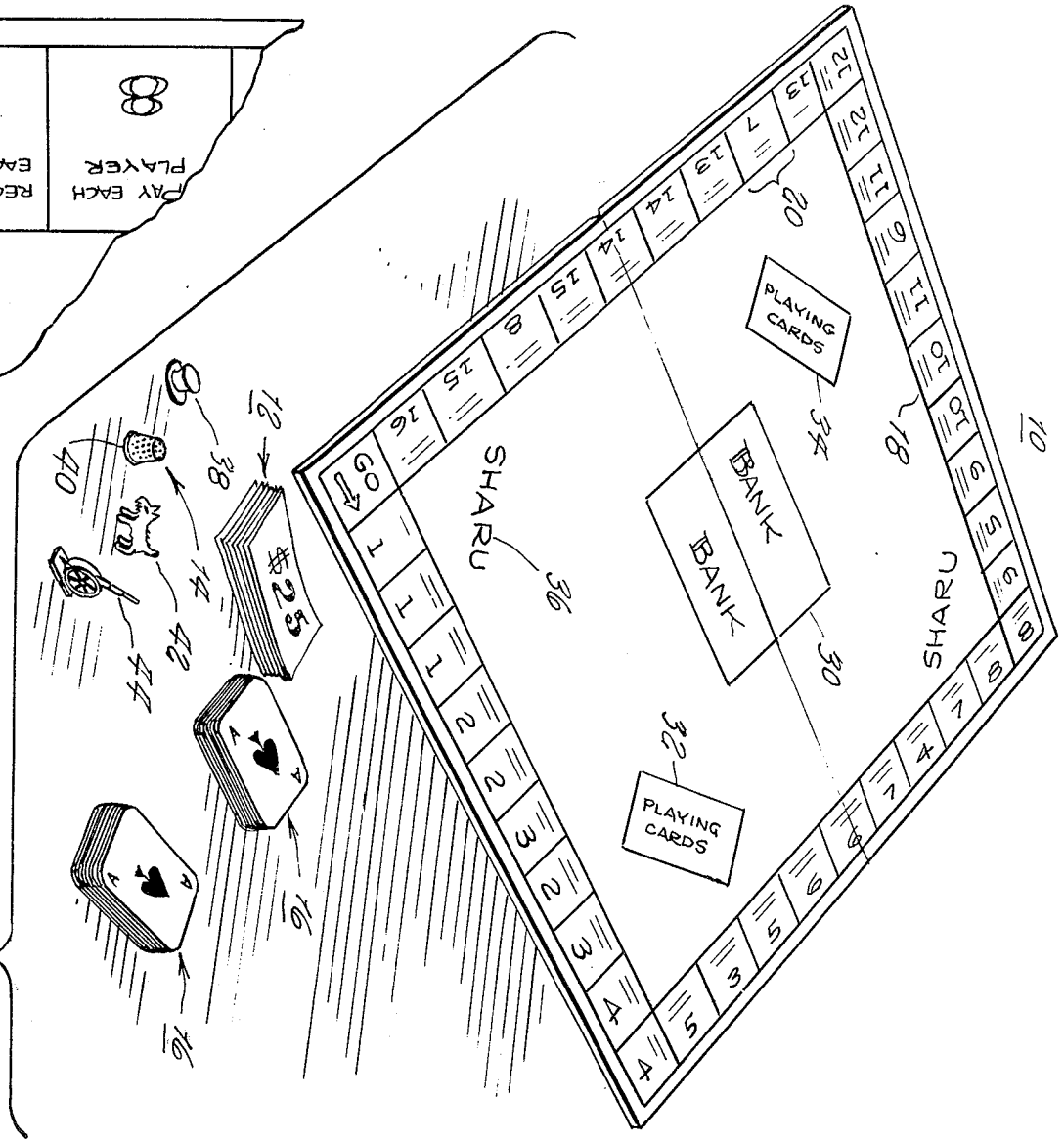
FIG. 1 is a perspective view of the various components forming the game apparatus of the present invention.

The basic elements of the game apparatus are shown in FIG. 1, and include the game board shown generally at 10, play money shown generally at 12, playing pieces shown generally at 14 and standard decks of playing cards shown generally at 16.

Figure 2:
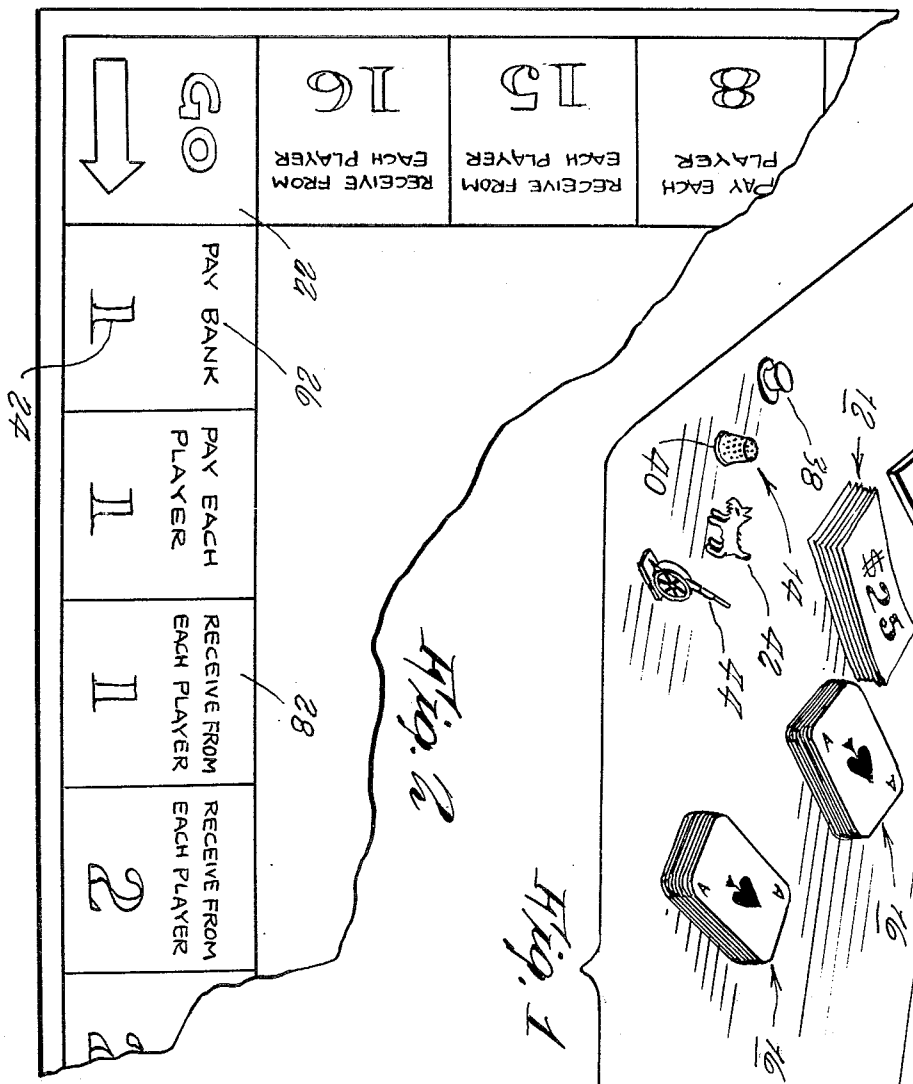
FIG. 2 is an enlarged sectional view of the game board shown in a plan view.

The game board is of square shape and includes a continuous path around its perimeter 18 which is divided into consecutive spaces 20. Each of the spaces defines a playing position. As shown in FIG. 2 one of the spaces 22 is the first space and bears the indicia GO from which the game starts. Each of the other consecutive spaces includes a numeric indicia 24 as well as an instruction 26. The instruction represents a command to the player to pay or receive an amount of money. The amount of money to be paid or received is indicated by the numeric figures 24 in that square. In the embodiment shown, 40 spaces are included with one space containing the word GO and 39 additional spaces containing instructions. The following instructions are included: Pay Bank, Pay Each Player, and Receive From Each Player. Fifteen squares are marked with the designation Pay Bank; sixteen squares are marked with the designation Receive From Each Player and eight squares are marked with the designation Pay Each Player.

The amount which the individual player receives from the bank, or from each player, or the amount paid to each player is the numeric amount designated within a space. Thus, by way of example, in the space shown at 28, should a player land his playing piece on that space, the player would receive from each player $1.

Referring again to FIG. 1, the game board also consists of a bank storage section 30 shown in the center of the game board, and two playing card storage areas 32, 34 located diagonally on either side of the bank storage area 30. In the opposite diagonal corners there can be included other indicia, as for example, the name of the game, as shown by the words SHARU, shown at 36. The play money 12 included in the game is formed of paper which bears indicia representing various denominations of money. In the present embodiment, the following denominations are included; $1., $5., $10., and $25.

The playing pieces are provided for use by each of the game players to identify himself and to move about in the various playing positions around the perimeter of the game board. While any type of game playing pieces can be utilized, in the present embodiment the game pieces are shown as figurines representing both animate and inanimate objects. For example, the playing piece 38 represents a cup; the playing piece 40 represents a thimble; the playing piece 42 represents a dog, and the playing piece 44 represents an antiaircraft gun. It is understood that other similar figurines could be utilized and these could be made of both different colors as well as of different shapes.

Two standard decks of playing cards are included. As is well known, such standard decks of cards include cards designated with clubs, spades, hearts, diamonds, jacks, kings, queens, aces and jokers. Most of the cards bear numeric values on them. In addition to the two standard packs of cards, each with two jokers, up to seven extra Joker cards are provided in order to accommodate as many as six players in the game.

It is therefore noted that the game includes a game board as well as decks of cards. The purpose of the cards is both to determine the number of playing spaces which the playing pieces are to be moved, and also for providing a particular combination of playing cards which will determine the winding hand.

As is well known, in card games, a particular combination of cards such as a full house, straight flush, etc., forms a winning hand over opponent players. On the other hand, in board games, it is generally the number of positions or the amount of money collected which are the features of such types of games. In the present invention the features of both types of games are utilized simultaneously in a single game. At the same time, the playing cards, while used for the usual purpose of forming combinations of playing cards in the winner's hands, are also used simultaneously for determining the number of moves in the game. By utilizing the playing cards for these dual purposes, a proper balance between skill and chance is achieved to provide a unique entertaining game apparatus.

The rules for playing the present game are as follows. Initially, when starting, each player receives four cards. Each player also selects one of the playing pieces to represent himself on the board and to mark his position along the perimeter of playing positions. The playing pieces are initially placed on the GO space.

Each player receives a total of $300. of playing money in the following denominations: 50 — one dollar bills, 10 — five dollar bills; 10 — ten dollar bills; and 4 — twenty-five dollar bills. The remainder of the playing cards are placed face down in one of the playing card spaces. The remainder of the money is placed in the bank in the center position on the game board.

The player to start the game draws one card from the top of the faced down cards on the board. The player will then have a total of five cards in his hand out of which he must discard one of the cards. The card which the player discards is placed face up in the other playing card storage space. The number on the discarded card will determine the number of squares which the player moves his playing piece. The square marked GO is counted as one of the squares for counting purposes.

On those playing cards having a numeric designation, such as the five of hearts, the player will move five spaces. For those cards not having numeric designations, the following rules will apply: the jack counts as 11 moves; the queen counts as 12 moves; and the king counts as 13 moves.

After the player has moved his playing piece to the particular playing position determined by the number on the card, the player carries out the instructions marked on the particular square on which he has stopped. He will therefore either pay the bank an amount of money, pay each player an amount of money, or receive from each player an amount of money. Once the card has been discarded, the other players cannot use that discarded card.

The object of the game is to win all of the money in the bank. This can be done by proceeding around the board with the playing pieces and collecting the money from the bank and the players, or can also be achieved by a player holding four aces in his hand at once. The four aces represent the combination winning hand of the game.

Each pack of cards includes two jokers. The jokers are counted as aces. There are also provided seven extra jokers which are also counted as aces and are utilized depending upon the number of players in the game. Thus, when two players are involved, no extra jokers are used. When three players are involved, two extra jokers are used. When four players are involved, five extra jokers are used. When five players are involved, eight jokers are used and when six players are involved a total of eleven jokers are used, namely, the four in the two packs of cards and the seven extra jokers.

While the particular rules heretofore described have defined a particular combination of playing cards to form the winning hand, it is understood that other combinations of playing cards can also be set in the rules to provide the winning hand. It is therefore seen that the heretofore described game apparatus combines the features of both a standard board game and a standard card game providing the movement of playing pieces and instructions in the playing positions as is typical in board games. At the same time, it provides unique combinations of playing cards as is typical in card games. However, in interrelating the two games the playing cards serve simultaneously the purpose of determining the number of spaces in the board game movement as well as providing the combinations for the winning hand.

There has been disclosed heretofore the best embodiment of the invention presently contemplated. However, it is understood that various changes and modifications may be made thereto without departing from the spirit of the invention.

What is claimed is:

1. In a game apparatus, the combination of a game board having a continuous path around its perimeter divided into consecutive spaces bearing instructions representing amounts to be paid or received during the game, each of said spaces defining a playing position, a plurality of playing pieces one for each of the game players, said playing pieces being of a size to fit within said playing positions, play money of different denominations for distribution of part thereof to each player, and at least two decks of standard playing cards for distribution of at of least some of the cards in equal allotment to each of the players, the cards simultaneously bearing indications representing the number of playing positions to be moved by a playing piece and also bearing representations forming a part of win determining means, said game board further comprising a bank area for storing the remainder of the play money not distributed to the players and said apparatus further comprising a plurality of additional cards, all of a single type, said single type being one of the types already included within each of said decks of playing cards.

2. The combination as in claim 1 and wherein said playing pieces represent figurines of animate and inanimate objects.

3. The combination of claim 1 and wherein said game board further comprises two playing card areas, one for storing said playing cards prior to selection by the players, and the other for storing said playing cards after being discarded by the players.

4. The combination of claim 1 and wherein said single type of card is the Joker card.

5. The combination as in claim 4 and wherein there are included seven such Joker cards.

6. The combination of claim 1 and wherein said game board is square, said continuous path forming a further inner square within said perimeter.

7. The combination of claim 1 and wherein said play money comprises a plurality of papers bearing indicia representing denominations of money.

8. The combination of claim 7 and wherein said denominations are of 1 dollar, 5 dollars, 10 dollars and 25 dollars.

* * * * *